US006975827B2

(12) United States Patent
Wessells

(10) Patent No.: US 6,975,827 B2
(45) Date of Patent: Dec. 13, 2005

(54) APPARATUS AND METHOD FOR IMAGE CAPTURE AND PAD TRANSFER

(76) Inventor: Philip G. Wessells, 123 Cascade Dr., Mill Valley, CA (US) 94941

( * ) Notice: Subject to any disclaimer, the term of this patent is extended or adjusted under 35 U.S.C. 154(b) by 91 days.

(21) Appl. No.: 10/628,820

(22) Filed: Jul. 28, 2003

(65) Prior Publication Data

US 2005/0025532 A1 Feb. 3, 2005

(51) Int. Cl.[7] ..... G03G 15/00; G03G 15/16
(52) U.S. Cl. ..... 399/297; 399/388
(58) Field of Search ..... 399/297, 381, 399/388, 393, 411; 347/104, 215; 400/23, 24, 27–29; 101/41, 44

(56) References Cited

U.S. PATENT DOCUMENTS

| | | | | |
|---|---|---|---|---|
| 4,766,810 A | * | 8/1988 | Alt | 101/217 |
| 5,634,730 A | | 6/1997 | Bobry | |
| 5,782,494 A | * | 7/1998 | Crandall et al. | 281/2 |
| 6,357,939 B1 | | 3/2002 | Baron | |
| 6,499,840 B2 | | 12/2002 | Day | |
| 6,517,266 B2 | | 2/2003 | Saund | |
| 6,674,543 B2 | | 1/2004 | Day | |
| 2003/0083967 A1 | | 5/2003 | Fleming | |

FOREIGN PATENT DOCUMENTS

| | | | | |
|---|---|---|---|---|
| EP | 0564297 A2 | | 6/1993 | |
| JP | 9-58073 A | * | 3/1997 | B41J/3/28 |
| JP | 2001071567 | | 3/2001 | |
| WO | WO 03/069453 A1 | | 8/2003 | |
| WO | WO 03/091032 A1 | | 11/2003 | |

OTHER PUBLICATIONS

Machine translation of JP 9–58073 A to Saka from Japanese Patent Office website.*

(Continued)

*Primary Examiner*—William J. Royer
(74) *Attorney, Agent, or Firm*—Patent Law Offices of Michael E. Woods

(57) ABSTRACT

The present invention includes apparatus and method for image transfer onto one of a plurality of a pad medium pages while the pages are aggregated together. A preferred embodiment for an image transfer system, including a housing; an image capture system, within the housing and coupled to a transfer engine, for producing an image; the transfer engine, within the housing, for transferring the image to a transfer medium when the transfer medium is located at a transfer position; a transfer medium registration system, coupled to the transfer engine, for positioning a pad including a plurality of transfer media releasably secured to one another, wherein the transfer registration system locates one of the transfer media at the transfer position. An image transfer method includes capturing an image using an image capture system within a housing; positioning a pad at a transfer position of a transfer engine inside the housing, the pad including a plurality of transfer media releasably secured to one another; and transferring the image to one of the transfer media positioned at the transfer position.

24 Claims, 2 Drawing Sheets

OTHER PUBLICATIONS

G4TECHTV, Review: Sony DPP–MP1 Digital Photo Printer, Feb. 15, 2002 (http://www.g4techtv.com/freshgear/features/19392/Review_Sony_DPPMP1_Digital_Photo_Printer_pg1.html).

Lisa Eccles, Digital Camera With Built–In Printer Looms On The Horizon, Jan. 22, 2001 (Electronic Design Web—http://www.elecdesign.com/Articles/Print.cfm?ArticleID=4262).

Revolutionary New Inkjet Technology Debuts in Canon U.S.A.'s N1000/N2000 Office Color Printers, Apr. 23, 2002 (http://www.businesswire.com/webbox/bw.042302/221132587.htm).

Blog Entry: Biz Stone—"Printer Idea" entry, Oct. 24, 2002 (http://www.bizstone.com/archive/2002_10_20_archive-.htm).

Phoenix Maa, et. al., Redesign and Retrospective: A Redesign of the Palm V, operating system, and related applications, May 1, 2000. (Publication Information unavailable).

Printdreams, The RMPT, white paper, Oct. 16, 2002 (http://www.printdreams.com/inside/whitepaper.pdf).

* cited by examiner

APPARATUS AND METHOD FOR IMAGE CAPTURE AND PAD TRANSFER

The present application is related to both application Ser. No. 10/628,749 entitled, APPARATUS AND METHOD FOR PAD PRINTING, and application Ser. No. 10/628,750 entitled, APPARATUS AND METHOD FOR ANIMATION PAD PRINTING, and both filed on even date herewith. These applications hereby expressly incorporated by reference for all purposes.

BACKGROUND OF THE INVENTION

The present invention relates generally to imaging systems, and more particularly to imaging systems including systems for capturing and transferring an image to a pad of transfer medium.

There are many types of printing systems available today. These systems include dot-matrix, thermal printers, electrostatic image transfer, ink ejectment, and the like. These systems are adapted for printing successive images on individual sheets of separate pages drawn from a paper reserve stack. There are many different mechanisms for extracting individual sheets and directing them to the image application portion of the printer. What these printers have in common is that the printing systems are adapted for accessing, controlling, routing and printing a single sheet at time.

Pads of note paper, such as Post-It® brand sticky note pads available from 3M Corporation of Minnesota, are well known. These pads include stacks of pages releasably secured to each other with a tacky adhesive that permits an individual page to be removed from the pad and re-adhered to another surface. This feature of releasable securement to successive surfaces is a desirable trait of these products.

Currently to produce an image on a sticky note, a user either writes or otherwise applies some text or graphic element on the topmost page of the pad of sticky note. Later, the user removes the note to reposition it to the desired location. It would be advantageous to use a printing system to apply the element to the sticky note page. However, the current printing systems are incapable of printing on such a pad. 3M offers a solution for printing on a preformed matrix of single layer note pages arranged in a standard 8"×11" format for running through a conventional printer.

This solution has disadvantages in that it requires access to, and use of, a full-size printer and associated computer system to reproduce the element on the note. Also, the user has to obtain pages of the special format, as well as special software for use in cooperation with the computer system operating the printer.

There are cameras designed for producing hardcopy facsimiles of images captured through an optical field-of-view. These cameras require a special package of film for producing instant hardcopy pictures. Examples include Polaroid instant cameras using instant film and peel-apart film. The instant film implements a self-developing process in which the image is captured and developed directly on the film and not transferred. Polaroid also makes an iZone camera that includes both digital "film" and a special version of instant film. Digital film records an image in onboard memory, and the image is later transferred to a separate machine (computer or special printer) to print hardcopies of desired images from the digital film. The instant film for the iZone develops a captured image directly on the film and includes a semi-tacky adhesive backing for temporary attachment of the picture to another surface. These solutions have the drawback that the instant cameras only provide instant images when used with instant film. The instant film is a specialty product that is not widely available, and has a cost that is not insubstantial.

SUMMARY OF THE INVENTION

The present invention includes apparatus and method for image transfer onto one of a plurality of a pad medium pages while the pages are aggregated together. A preferred embodiment for an image transfer system, including a housing; an image capture system, within the housing and coupled to the transfer engine, for producing an image; a transfer engine, within the housing, for transferring the image to a transfer medium when the transfer medium is located at a transfer position; a transfer medium registration system, coupled to the transfer engine, for positioning a pad including a plurality of transfer media releasably secured to one another, wherein the transfer registration system locates one of the transfer media at the transfer position. An image transfer method includes capturing an image using an image capture system within a housing; positioning a pad at a transfer position of a transfer engine inside the housing, the pad including a plurality of transfer media releasably secured to one another; and transferring the image to one of the transfer media positioned at the transfer position.

The preferred embodiment of the present invention is provided as a stand-alone system for receiving a pad of a plurality of transfer media and for capturing and transferring an image to one of the transfer media. The imaged transfer medium may be printed while attached, or in some implementations, after being stripped from the pad. In some implementations, a transfer registration system ejects a print medium after printing, or a user removes the pad after printing, removes the printed medium, and then reinserts the pad. Virtually any image from a scene may be captured and transferred, limited by the image transfer engine, the image source quality (e.g., a quality of the image capture system) and pad size.

These and other novel aspects of the present invention will be apparent to those of ordinary skill in the art upon review of the drawings and the remaining portions of the specification.

DESCRIPTION OF THE SPECIFIC EMBODIMENTS

Figure 1:
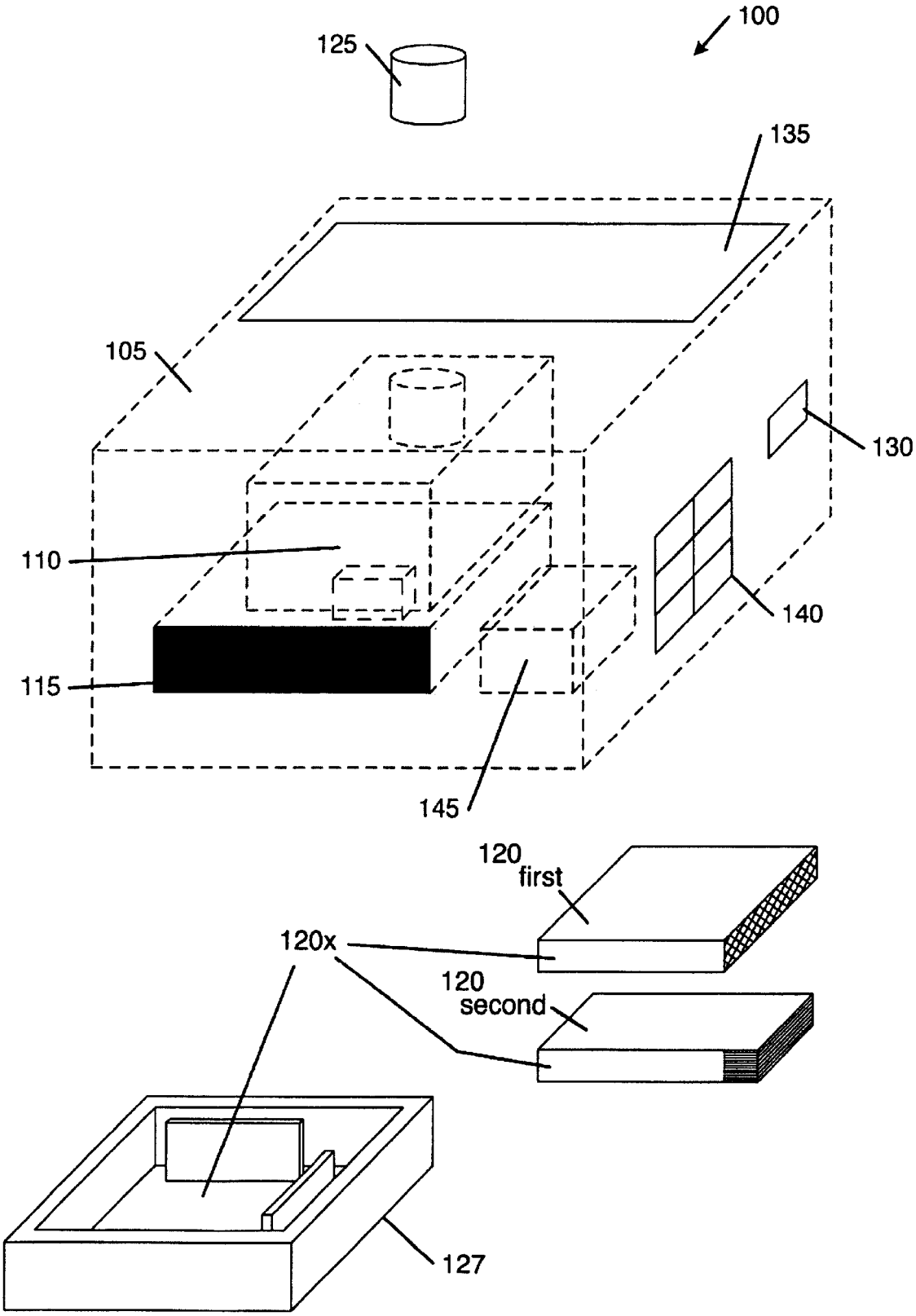
FIG. 1 is a block perspective view of a preferred embodiment of the present invention for a pad printing system.

FIG. 1 is a block perspective view of a preferred embodiment of the present invention for a pad transfer system 100 (e.g., image transfer system or image transfer apparatus). Pad transfer system 100 includes a housing 105, an image transfer engine 110, a transfer registration system 115 for receiving a pad 120*x* (selected from a set of possible pads including a first type of pad $\mathbf{120}_{FIRST}$ and a second type of pad $\mathbf{120}_{SECOND}$ using a cartridge 127. Cartridge 127 includes sliders (as well known in the art) for adjusting an internal storage capacity to varying peripheries (e.g., paper sizes) of pad 120*x* and appropriately registering pad 120*x* to image transfer engine 110. Pad 120FIRST is a pad having adhesive adhered to one edge of each sheet, and pad 120SECOND is a pad having adhesive adhered between successive layers proximate one edge. Hereafter, any pad 120*x* will be substitutably referred to as pad 120 and pad 120 as used herein below includes any pad 120*x*.

Figure 2:
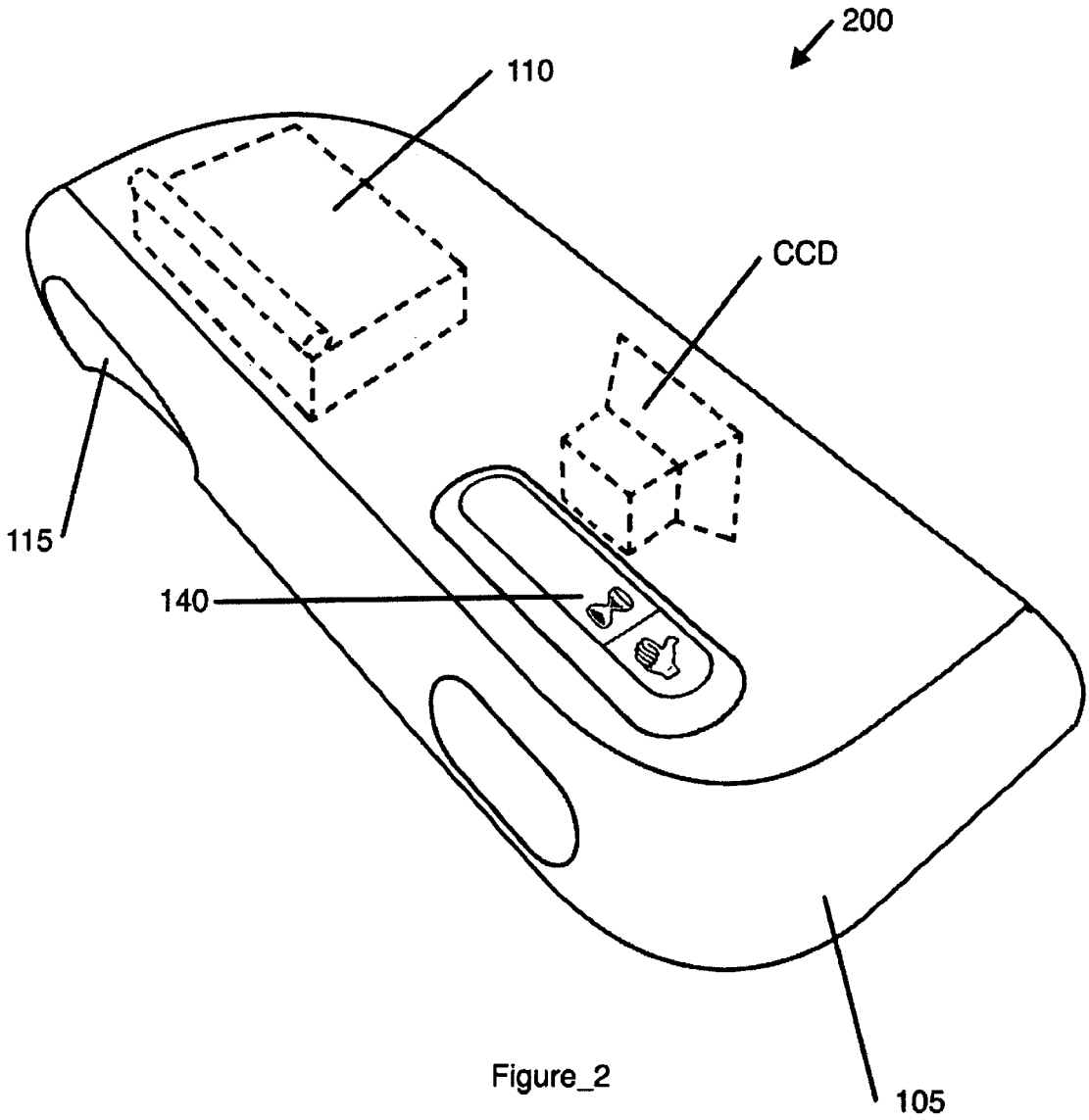
FIG. 2 is a perspective view of the preferred embodiment implemented in an image capture system.

Housing 105 contains the elements of pad transfer system 100. Housing 105 preferably also incorporates additional functionality for enabling image capture, as shown in FIG. 2. Pad transfer system 100 may also be enabled to work cooperatively with an image capture system, with the image capture system physically or logically integrated with pad transfer system 100.

Image transfer engine 110 is a device for applying a text or graphic element onto pad 120 when pad 120 is registered within transfer registration system 115. Image transfer engine 110 may include conventional printing systems such as, for example, a laser printer, an inkjet printer, a thermal printer, a dot-matrix printer, or the like. Image transfer engine 110 may include imaging systems like stenciling and stamping as well. Therefore image transfer engine 110 of the preferred embodiment denotes a system that imparts a perceptible image onto or into one of a transfer medium of pad 120, and the term print is used in a generic sense to include all such transfer processes.

In some implementations, image transfer engine 110 uses a printing system that consumes a print resource during the transfer process (e.g., toner in a laser printer or ink in an inkjet printer). Pad transfer system 100 may provide for replaceable resource sources 125 (e.g., an ink cartridge or toner cartridge) or provide for replacement of a complete image transfer engine 110 that is new or refurbished with a fresh supply of the resource.

Pad transfer system 100 includes a processing unit for controlling the functions, and includes memory for storing program instructions and, in some cases, images in a format suitable for use with image transfer engine 110. This memory may include portions that are volatile, non-volatile or some combination. In some implementations, pad transfer system 100 includes one or more image access ports 130, coupled to the controller, memory, or directly to image transfer engine 110. Image access port 130 is a receiver/receptacle adapted to operatively mate with memory modules storing one or more images for application using pad transfer system 100, or for coupling to another device or source of images, such as, for example, a computing system, a camera, a scanner, a video camera, or the like. Some implementations and embodiments of the present invention include rechargeable batteries to power the transfer functions. Image access port 130 may be integrated into a docking station for receiving, storing, powering and otherwise interfacing to the image transfer system or to an image capture system, or both. The docking system may be used for systems lacking the rechargeable batteries.

In some implementations of the preferred embodiment, pad transfer system 100 includes a display 135 for reproducing a facsimile of an image to be transferred, or transferred by, image transfer engine 110. Display 135 also provides feedback during control or operation functions. A portion of display 135 provides feedback regarding the status of the image transfer process, such as that pad transfer system 100 is ready to begin transfer, transfer is ongoing, and/or transfer has completed.

A control system 140 includes one or more buttons coupled to the controller for actuating an image transfer process, selecting an image for transfer, accessing images through image access port 130. In the preferred embodiment, control system 140 includes a, PRINT, button, the actuation of which initiates an image transfer process.

Transfer registration system 115 receives pad 120 and positions one transfer medium of the plurality of transfer media at a location to cooperate with image transfer engine 110 in the image transfer process. Pad 120 of the preferred embodiment is a stack of uniformly sized transfer medium elements (e.g., sheets of paper, though other substrates or materials are possible, including Mylar film, decals, and the like) releasably secured to each other. In the preferred embodiment, pad 120 is a stack of sticky note pads, like the Post-It® sticky note pad product. Registration system 115 locates the topmost transfer medium at the print position and holds pad 120 during the image transfer process.

In some embodiments, registration system 115 may position the bottommost transfer medium, or some other portion of pad 120. Registration system 115 may include adapter/cartridge 127 for holding pad 120 during image transfer. Such an adapter/cartridge 127 is configurable to permit registration of different sized pads 120 (size differing in thickness and/or peripheral dimensions).

Registration system 115 also includes, in some implementations, a stripper 145 for pulling a single transfer medium off pad 120, either before image transfer or after. Stripper 145, depending upon its functions, may be implemented in numerous different ways. A simple implementation includes a blade or roller that slides between a sheet and the remainder of pad 120 to lift, separate and remove the sheet.

It is understood that pad transfer system 100 may also be implemented as a simple device without the display, image access ports, and controls. When inserting pad 120 sufficiently far into registration system 115, image transfer begins. An LED is illuminated while the transfer process is in progress. When the LED extinguishes, pad 120 is removed with one of the pages bearing the transfer image.

In operation, a user loads pad 120 into registration system 115 that in turn locates one of the transfer medium at the desired location. A user selects a particular image for transfer, either from internal memory or from an external source through image access port 130. The selected image is viewed on display 135, and the user actuates the, PRINT, button to initiate the transfer system. When the transfer process is completed, the transfer medium, either individually or as part of pad 120, is removed from pad transfer system 100.

FIG. 2 is a perspective view of the preferred embodiment implemented in an image capture/print system 200 including a roller as ejection mechanism 145 shown in FIG. 1. System 200 is configured similar to pad transfer system 100 as shown in FIG. 1, and includes an image capture portion (e.g., camera, video camera or scanner). The camera includes a charge-coupled device (CCD) for collecting an image from a desired field-of-view, with the collected image stored into the memory or sent directly to image transfer engine 110 for transfer to pad 120. When the capture system is integrated into a housing, such as housing 105 as shown in FIG. 1, the memory and controller may be shared between the capture system and pad transfer system 100. When physically distinct, image access port 130 may transfer images from the capture system to the transfer system. When integrated, a shutter, control of the image capture system may also initiate operation of image transfer engine 110.

As used herein, pad 120 includes collections of print media not only secured to each other using a semi-tacky re-attachable adhesive (e.g., Post-It® notes) but also to releasable securement systems such as edge-applied adhesive laminate and other binding systems that hold the media together while permitting one or more medium elements to be detached.

The above-described arrangements of apparatus and methods are merely illustrative of applications of the principles of this invention and many other embodiments and modifications may be made without departing from the spirit and scope of the invention as defined in the claims.

These and other novel aspects of the present invention will be apparent to those of ordinary skill in the art upon review of the drawings and the remaining portions of the specification.

What is claimed is:

1. An image transfer system, comprising:

a housing;

an image capture system, within said housing, for photographically producing an image of an object within a field of view of said image capture system;

a transfer engine, within said housing and coupled to said image capture system, for transferring said image to a transfer medium when said transfer medium is located at a transfer position; and a transfer medium registration system, coupled to said transfer engine, for positioning a pad including a plurality of transfer media releasably secured to one another, wherein said transfer medium registration system locates one of said transfer media at said transfer position.

2. The image transfer system of claim 1 wherein said transfer engine includes an electrostatic transfer system.

3. The image transfer system of claim 1 wherein said transfer engine includes an ink ejection system.

4. The image transfer system of claim 1 wherein said transfer engine includes a thermal transfer system.

5. The image transfer system of claim 1 wherein said transfer medium registration system includes a cartridge for storing said pad.

6. The image transfer system of claim 5 wherein said cartridge adapts a plurality of pads having differing cross-sectional areas to said transfer medium registration system.

7. The image transfer system of claim 1 further comprising a pad including a plurality of transfer media releasably secured to one another, wherein said transfer medium registration system locates said one of said transfer media of said pad at said transfer position and wherein said one of said transfer media is a top-most transfer media of said pad.

8. The image transfer system of claim 1 further comprising a pad including a plurality of transfer media releasably secured to one another, wherein said transfer medium registration system locates said one of said transfer media of said pad at said transfer position and wherein said one of said transfer media is a bottom-most transfer media of said pad.

9. The image transfer system of claim 1 further comprising a pad including a plurality of transfer media releasably secured to one another, wherein said transfer medium registration system locates said one of said transfer media of said pad at said transfer position and wherein said plurality of transfer media are secured using a semi-tacky adhesive disposed between successive edges of said plurality of transfer media.

10. The image transfer system of claim 1 further comprising a pad including a plurality of transfer media releasably secured to one another, wherein said transfer medium registration system locates said one of said transfer media of said pad at said transfer position and wherein said plurality of transfer media are secured using an adhesive adhered to a plurality of side edges of said plurality of transfer media.

11. The image transfer system of claim 1 wherein said transfer engine includes a replaceable cartridge containing a transfer medium for said transfer engine.

12. The image transfer system of claim 11 wherein said transfer engine includes an aperture for controllably ejecting ink and said cartridge contains said ink.

13. The image transfer system of claim 1 wherein said transfer medium registration system includes a media stripper for removing said located one transfer medium from said pad.

14. The image transfer system of claim 13 wherein said transfer medium registration system ejects said removed transfer medium from said housing.

15. The image transfer system of claim 1 wherein said transfer engine is a printer.

16. An image transfer method, the method comprising:

capturing photographically an image using an image capture system within a housing;

positioning a pad at a transfer position of a transfer engine inside said housing, said pad including a plurality of transfer media releasably secured to one another; and transferring said image to one of said transfer media positioned at said transfer position.

17. The image transfer method of claim 16 wherein said one of said transfer media is releasably secured to said pad when said image is transferred.

18. The image transfer method of claim 16 wherein said one of said transfer media is detached from said pad when said image is transferred.

19. An image transfer apparatus, comprising:

means for capturing photographically an image using an image capture system within a housing;

means, coupled to said means for capturing, for positioning a pad at a transfer position of a transfer engine inside said housing, said pad including a plurality of transfer media releasably secured to one another; and means for transferring said image to one of said transfer media positioned at said transfer position.

20. An image transfer system, comprising:

a housing;

an image capture system, within said housing, for producing an image;

a transfer engine, within said housing and coupled to said image capture system, for transferring said image to a transfer medium when said transfer medium is located at a transfer position;

a transfer medium registration system, coupled to said transfer engine, for positioning a pad including a plurality of transfer media releasably secured to one another, wherein said transfer medium registration system locates one of said transfer media at said transfer position, wherein said transfer engine includes a thermal transfer system.

21. An image transfer system, comprising:

a housing;

an image capture system, within said housing, for producing an image;

a transfer engine, within said housing and coupled to said image capture system, for transferring said image to a transfer medium when said transfer medium is located at a transfer position;

a transfer medium registration system, coupled to said transfer engine, for positioning a pad including a plurality of transfer media releasably secured to one another, wherein said transfer medium registration system locates one of said transfer media at said transfer position, wherein said transfer medium registration system includes a cartridge for storing said pad.

22. The image transfer system of claim 21 wherein said cartridge adapts a plurality of pads having differing cross-sectional areas to said transfer medium registration system.

23. An image transfer system, comprising:

a housing;

an image capture system, within said housing, for producing an image;

a transfer engine, within said housing and coupled to said image capture system, for transferring said image to a transfer medium when said transfer medium is located at a transfer position;

a transfer medium registration system, coupled to said transfer engine, for positioning a pad including a plurality of transfer media releasably secured to one another, wherein said transfer medium registration system locates one of said transfer media at said transfer position, wherein said transfer medium registration system includes a media stripper for removing said located one transfer medium from said pad.

24. The image transfer system of claim 23 wherein said transfer medium registration system ejects said removed transfer medium from said housing.

* * * * *